US007102582B2

(12) United States Patent
Sato

(10) Patent No.: US 7,102,582 B2
(45) Date of Patent: Sep. 5, 2006

(54) PLANAR ANTENNA AND RADIO APPARATUS

(75) Inventor: Masaru Sato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 38 days.

(21) Appl. No.: 11/061,886

(22) Filed: Feb. 22, 2005

(65) Prior Publication Data

US 2006/0061513 A1 Mar. 23, 2006

(30) Foreign Application Priority Data

Sep. 21, 2004 (JP) ..... 2004-273943

(51) Int. Cl.
*H01Q 13/10* (2006.01)

(52) U.S. Cl. ..... 343/767; 343/700 MS

(58) Field of Classification Search ..... 343/767, 343/700 MS, 771, 786, 768, 769, 770, 783
See application file for complete search history.

(56) References Cited

U.S. PATENT DOCUMENTS 5,081,466 A * 1/1992 Bitter, Jr. ..... 343/767
5,428,364 A * 6/1995 Lee et al. ..... 343/767
5,519,408 A * 5/1996 Schnetzer ..... 343/767
6,317,097 B1 * 11/2001 Smith ..... 343/789
6,867,742 B1 * 3/2005 Irion et al. ..... 343/767
2005/0012672 A1 * 1/2005 Fisher ..... 343/767

FOREIGN PATENT DOCUMENTS

JP 2000-307334 11/2000
JP 2001-320228 11/2001
JP 3462959 8/2003

OTHER PUBLICATIONS

"Development of Millimeter-Wave Passive Imaging Array", 2003 IEICE Abstract C-2-103, RIEC, Tohoku University, Kentaro Kanari, et al., p. 135.
Kentaro Kanari, et al., 2003 IEICE Abstract C-2-103, RIEC, Tohoku University, "Development of Millimeter-Wave Passive Imaging Array (1)", p. 135.

* cited by examiner

*Primary Examiner*—Trinh Dinh
*Assistant Examiner*—Huedung X. Cao
(74) *Attorney, Agent, or Firm*—Arent Fox PLLC

(57) ABSTRACT

A planar antenna is formed of a circuit substrate and a slot line formed on the circuit substrate for guiding an electromagnetic wave in an axial direction thereof, the planar antenna emitting the electromagnetic wave at an end part of said slot line, wherein the end part has a curved shape forming a focal point at a location on an axis of the slot line with offset by a distance of about a quarter wavelength of the electromagnetic wave, and wherein there is provided a conductor pattern having a length of about a half of the wavelength of the electromagnetic wave at the focal point.

20 Claims, 9 Drawing Sheets

PLANAR ANTENNA AND RADIO APPARATUS

CROSS-REFERENCE TO RELATED APPLICATION

The present application is based on Japanese priority application No. 2004-273943 filed on Sep. 21, 2004, the entire contents of which are hereby incorporated by reference.

BACKGROUND OF THE INVENTION

The present invention generally relates to radio apparatuses and more particularly to a planar antenna formed on a circuit substrate and a radio apparatus having such a planar antenna.

Investigations are being made on a planar antenna formed integrally on a circuit substrate in relation to radar sets of millimeter wavelength band. On the other hand, such a planar antenna is also important in the field of radio astronomy.

Conventionally, high-performance antennas that use a waveguide have been used for the reception of millimeter wavelength band radio signals.

However, such an antenna that uses a waveguide forms a three-dimensional circuit of heavy weight, and raises the problem of high cost. In addition, such an antenna that uses a waveguide raises the problem that it cannot be coupled to a semiconductor integrated circuit device directly.

In view of the foregoing circumstances and situations, investigations are being made in relation to the radar apparatuses of millimeter wavelength band to provide a planar antenna capable of being formed on a circuit substrate by patterning a metal film.

Patent Reference 1 Japanese Laid-Open Patent Application 2001-320228 Official Gazette Patent Reference 1 Japanese Laid-Open Patent Application 2000-307334 Official Gazette Japanese Patent 3,462,959

Non-Patent Reference 1 2003 IEICE Abstract C-2-103

SUMMARY OF THE INVENTION

FIG. 1 shows the construction of a patch antenna 11, which may be the simplest antenna formed on such a circuit substrate 10 by patterning of a metal film.

Referring to FIG. 1, the patch antenna 11 comprises a main part 11A of a metal pattern and an interconnection pattern 11B extending over the circuit substrate 10 from the foregoing main part 11A to a semiconductor integrated circuit (not shown), wherein the main part 11A has a size of a half wavelength.

Such a patch antenna 11 has an advantageous feature of simple construction, occupying a small area and has further advantage of easy designing. On the other hand, such a patch antenna naturally suffers from the problem of low antenna gain and non-directivity within the plane of the antenna. Thus, such a patch antenna is not suitable for the applications where high antenna gain is required.

Meanwhile, Patent Reference 3 discloses a taper slot planar antenna 21 shown in FIG. 2 that can provide an improved gain.

Referring to FIG. 2, the planar antenna 21 is basically a slot line 21B formed in a conductor pattern 21A provided on a circuit substrate 20, wherein the width W of the slot line

21B is increased gradually toward an antenna edge according to Fermi-Dirac function for optimization of impedance at such an antenna edge.

With the planar antenna 21 of FIG. 2, however, there arises a problem in that it becomes necessary to secure a length corresponding to four wavelengths for such an antenna edge where impedance optimization is to be made, for realizing the desired high antenna gain, while this means that it is necessary to secure an antenna length of at least 12 mm in the case the antenna is used with a millimeter wavelength band having the wavelength of 3 mm.

Thus, according to the technology of Patent Reference 3, there inevitably occurs a problem in that a large area of the circuit substrate is occupied by the antenna when attempt is made to achieve a high antenna gain, and it becomes necessary to provide a large circuit substrate. However, the use of such a large circuit substrate raises the problem that the efficiency of utilization of the surface area of the circuit substrate may be degraded.

Thus, in a first aspect, the present invention provides a planar antenna comprising: a circuit substrate; and a slot line formed on said circuit substrate for guiding an electromagnetic wave in an axial direction thereof, said planar antenna emitting said electromagnetic wave at an end part of said slot line, said end part having a curved shape forming a focal point at a location on an axis of said slot line with offset by a distance of about a quarter wavelength of said electromagnetic wave, wherein there is provided a conductor pattern having a length of about a half of said wavelength of said electromagnetic wave at said focal point.

In another aspect, the present invention provides a radio apparatus comprising a planar antenna and a semiconductor device connected to said planar antenna, said planar antenna comprising: a circuit substrate; and a slot line formed on said circuit substrate for guiding an electromagnetic wave in an axial direction thereof, said planar antenna emitting said electromagnetic wave at an end part of said slot line, said semiconductor device being provided on said circuit substrate commonly to said planar antenna, said end part having a curved shape forming a focal point on an axis of said slot line with an offset by a distance of about ¼ a wavelength of said electromagnetic wave, wherein there is provided a conductor pattern having a length of about ½ a wavelength of said electromagnetic wave at said focal point.

According to the present invention, it becomes possible to realize an extremely compact and high gain antenna by a slot line formed on a circuit substrate for guiding an electromagnetic wave in an axial direction thereof. The planar antenna thereby emits the electromagnetic wave at an end part of the slot antenna with large gain as a result of formation of the foregoing end part such that the end part has a curved shape forming a focal point on an axis of the slot line at a location offset by a distance of about ¼ a wavelength of the electromagnetic wave, and further by forming a conductor pattern at the focal point with a length of about ½ the wavelength of the electromagnetic wave. Further, by using such a compact high gain antenna for the radio apparatus, it becomes possible to utilize the area of the circuit substrate, on which the planar antenna is formed, efficiently and it becomes possible to downsize the radio apparatus.

Other objects and further features of the present invention will become apparent from the following detailed description when read in conjunction with the attached drawings.

BRIEF DESCRIPTION OF THE DRAWINGS

FIGS. 4A and 4B are diagrams showing the radiation characteristics of the planar antenna according to a first embodiment of the present invention while FIG. 4B shows the radiation characteristics of the taper slot antenna of FIG. 2.

DETAILED DESCRIPTION OF THE INVENTION

[First Embodiment]

Figure 3A:
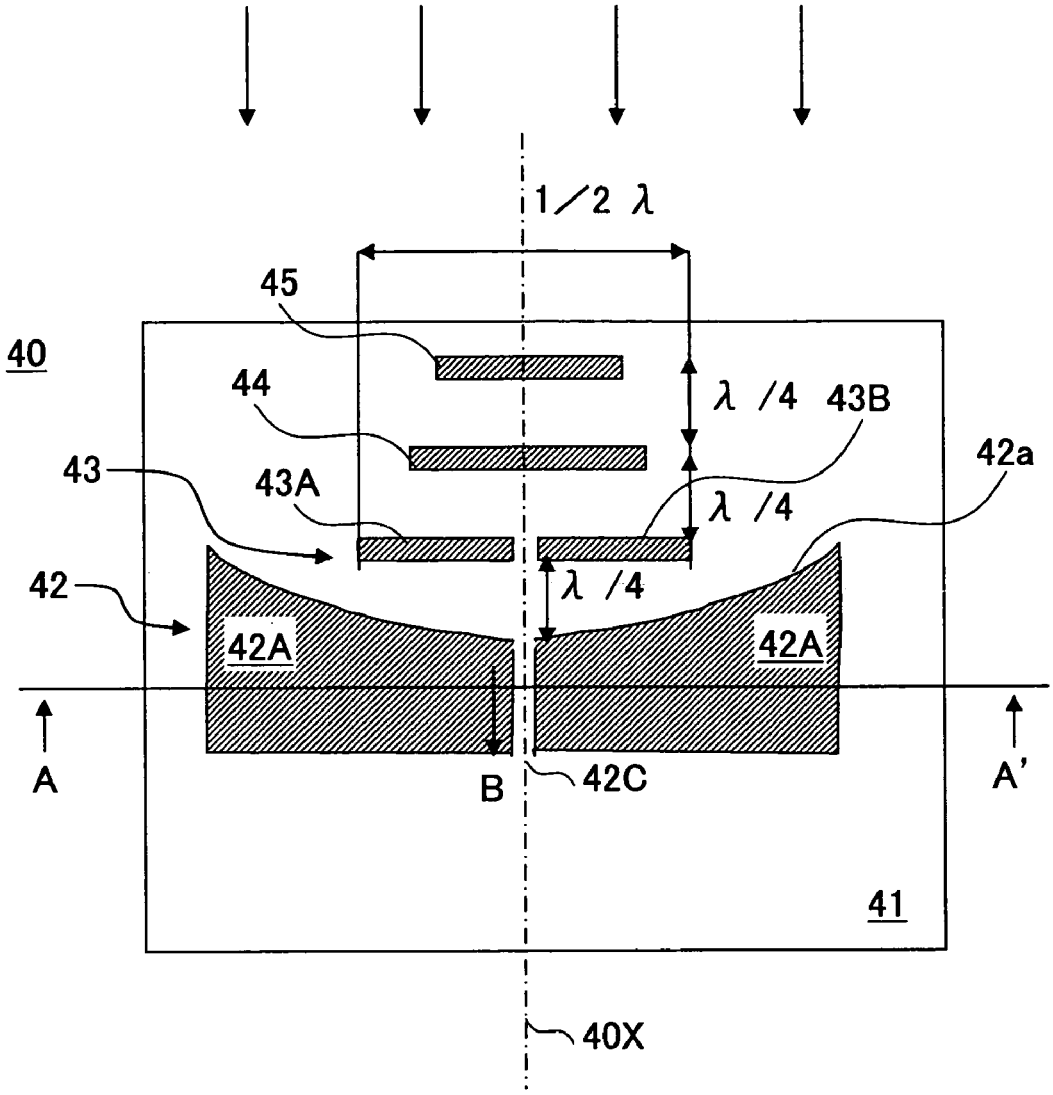
FIGS. 3A and 3B are diagrams showing the construction of a planar antenna according to a first embodiment of the present invention.
Figure 3B:
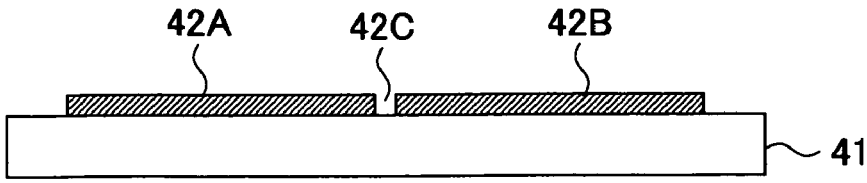

FIG. 3A is a plan view diagram of a planar antenna 40 according to a first embodiment of the present invention, while FIG. 3B shows the same planar antenna in a cross-sectional view taken along a line A—A' of FIG. 3A.

Referring to FIGS. 3A and 3B, the planar antenna 40 is formed on a low-loss circuit substrate 41 of ceramics, quartz glass or resin, wherein there is provided a slot line 42 on the circuit substrate 41 by conductor patterns 42A and 42B of Au, Cu, or the like, wherein the slot line 42 includes a slot 42C between the conductor patterns 42A and 42B and an electromagnetic wave of the frequency of typically in the order of 100 GHz (millimeter wave) is guided along the slot 42C in an axial direction 40*x* thereof as represented by an arrow B.

It should be noted that the slot line 42 has a curved end part 42*a* forming a generally parabolic shape in the illustrated example, wherein it should be noted that the curved shape of the end part 42*a* is determined such that there is formed a focal point of parabola on the axis 40*x* with an offset from the edge part 42 by a distance of about a quarter wavelength of the electromagnetic wave.

Further, on the circuit substrate 41, there is provided a resonator 43 formed of a pair of conductor patterns 43A and 43B and having a width of a half wavelength of the electromagnetic wave guided through the slot line 42 at a location offset by a distance of a quarter wavelength as measured from the foregoing edge part 42*a* located on the axis 40*x*, wherein the conductor patterns 43A and 43B are disposed symmetric about the foregoing axis 40*x* with a gap of 1/100–1/10 the wavelength of the foregoing electromagnetic wave.

Thus, when viewed from the side of the resonator 43, the slot line 42 is located at a location offset therefrom by a distance of a quarter wavelength of the electromagnetic wave and extends to the right and left with a width larger than a half wavelength of the foregoing electromagnetic wave. Thereby, the slot line 42 forms an inductive reflector.

Further, on the axis 40*x*, there is provided a capacitive wave director 44 by a conductor pattern shorter than the foregoing resonator 43 at a location further forward of the resonator 43 by a distance of about a quarter wavelength of the electromagnetic wave, and there is provided another capacitive wave director 45 by a conductor pattern still shorter than the director 44 at a location further forward of the resonator 44 by a distance of about a quarter wavelength of the electromagnetic wave.

Thus, while the planar antenna 40 of FIGS. 3A and 3B has a size of only a three-quarter wavelength in the axial direction thereof, the planar antenna 40 can perform effective concentration of the incoming electromagnetic wave energy incoming thereto from the axial direction thereof to the resonator 43 as a result of the guiding action of the wave directors 45 and 44 and further the reflection action of the reflector 42*a*, and as a result, the electromagnetic wave energy thus concentrated is effectively injected into the slot line 42 from the resonator 43.

Similarly, the planar antenna 40 of FIGS. 3A and 3B can emit the electromagnetic wave energy fed to the slot line 42 efficiently from the resonator 43 in the forward direction via the reflector 42*a* and the wave directors 44 and 45.

Figure 1:
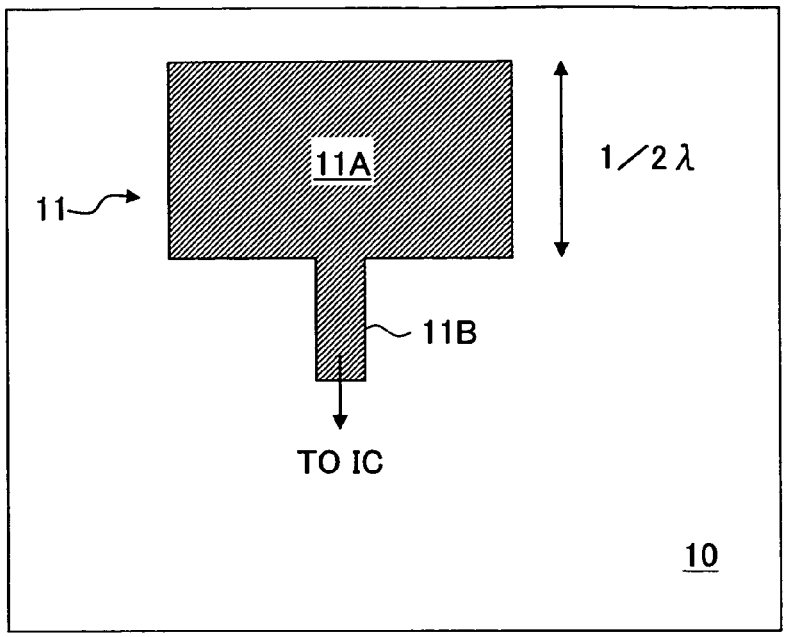
FIG. 1 is a diagram showing the construction of a conventional patch planar antenna.
Figure 2:
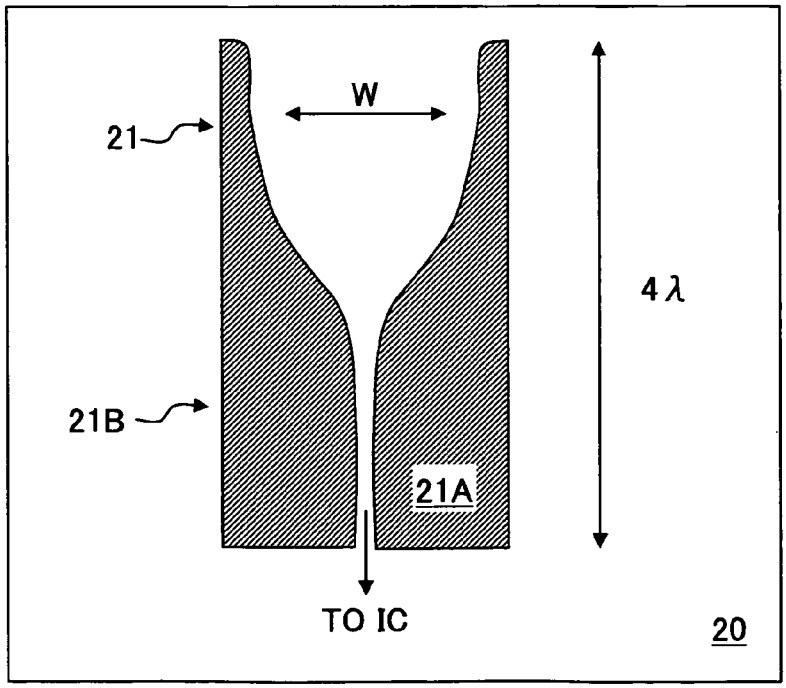
FIG. 2 is a diagram showing the construction of a conventional taper slot antenna.
Figure 4A:
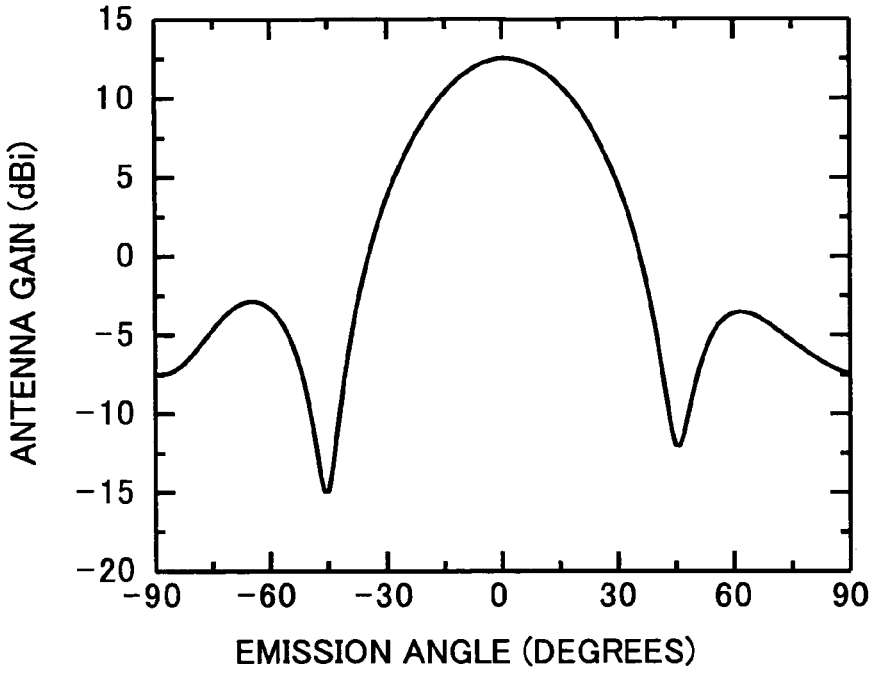
Figure 4B:
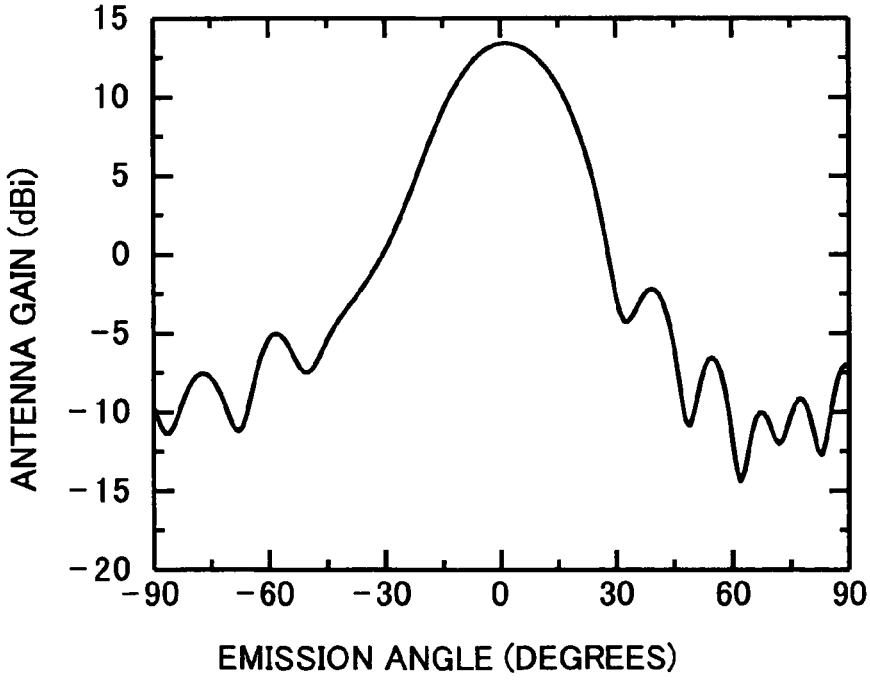

FIG. 4A is a diagram showing relationship between the antenna gain and the radiation angle obtained by simulation for the case the planar antenna 40 of FIGS. 3A and 3B is applied to the electromagnetic wave of the wavelength of 3 mm, while FIG. 4B shows a similar relationship between the antenna gain and the radiation angle also obtained by simulation for the case the planar antenna 20 of FIG. 2 is applied to the electromagnetic wave of the wavelength of 3 mm.

Referring to FIGS. 4A and 4B, it can be seen that the planar antenna 40 of the present invention, while having the total length of only a three-quarter wavelength of the electromagnetic wave in the axial direction as measured from the edge part of the slot line, can provide the gain and directivity generally equivalent to those of the conventional planar antenna 20, which has the total length of about four wavelengths in the axial direction.

In the present embodiment, it should be noted that the curve defining the reflector edge 42*a* may also be a hyperbolic line or an elliptic line.

[Second Embodiment]

Figure 5:
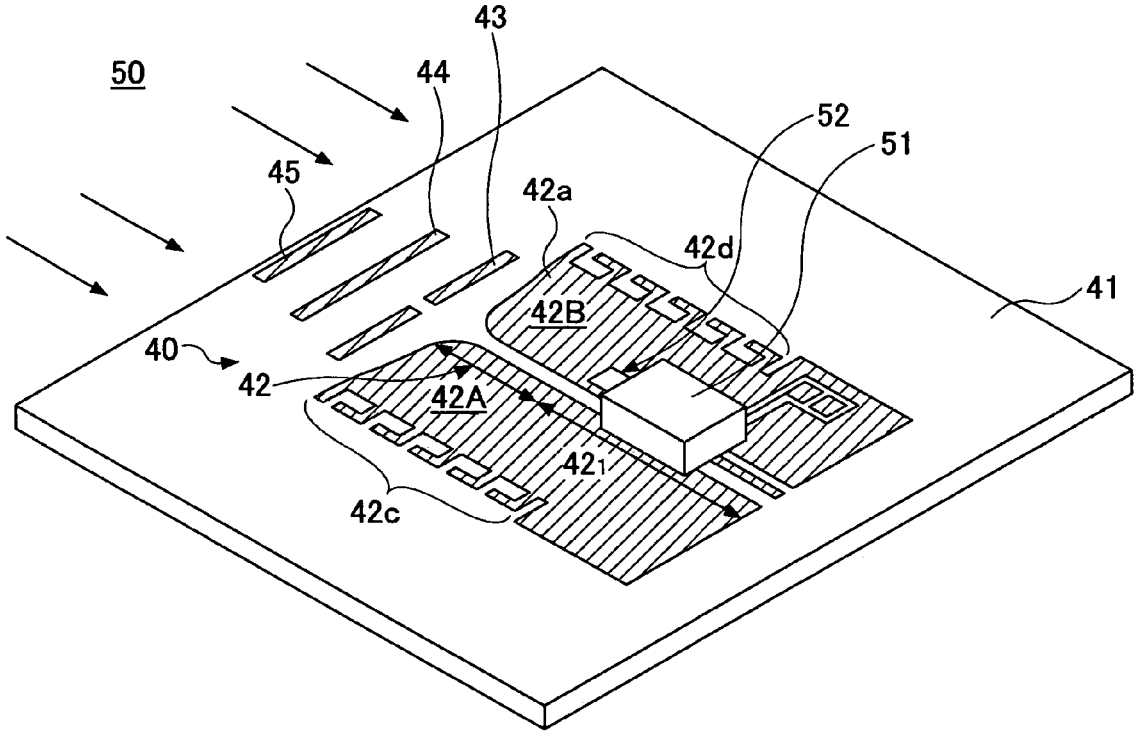
FIG. 5 is a diagram showing the construction of a radio apparatus according to a second embodiment of the present invention.

FIG. 5 shows the construction of a radio apparatus 50 that uses the planar antenna 40 according to a second embodiment of the present invention, wherein those parts corresponding to the parts described previously are designated by the same reference numerals and the description thereof will be omitted.

Referring to FIG. 5, the radio apparatus 50 is a receiver such as a passive radar set constructed on the circuit substrate 41 for detecting feeble incoming millimeter waves and includes a semiconductor chip 51 flip-chip mounted on the conductor patterns 42A and 42B constituting the planar antenna 40. It should be noted that the semiconductor chip 51 includes therein a low-noise amplifier and amplifies the electromagnetic wave collected by the planar antenna 40 and injected into the slot line 42 with high gain.

In the construction of FIG. 5, there is formed a coplanar line $\mathbf{42}_1$ in continuation with the slot line 42 that forms the planar antenna 40, and the semiconductor chip 51 is formed on such a coplanar line 421. Further, there is formed a line conversion part 52 between the slot line 42 and the coplanar line 421.

Further, there are formed choke structures 42*c* and 42*d* at the outer periphery of the conductor patterns 42A and 42B for the purpose of cutting off the surface wave as will be explained in detail with reference to FIG. 10.

Thus, with the radio apparatus 50 of FIG. 5, the incoming millimeter wave represented by the arrows is collected by the high-gain planar antenna 40 and is injected into the slot line 42. The electromagnetic wave thus injected into the slot 42 is introduced into the coplanar line $\mathbf{42}_1$ via the conversion part 52 and is processed by the semiconductor chip 51.

Further, the radio apparatus 50 can be used also as a transmitter of millimeter wavelength band or as a transceiver as in the case of an active radar set. In such a case, a high power transmission chip or transceiver chip or module is used in place of the semiconductor chip 51.

Figure 6A:
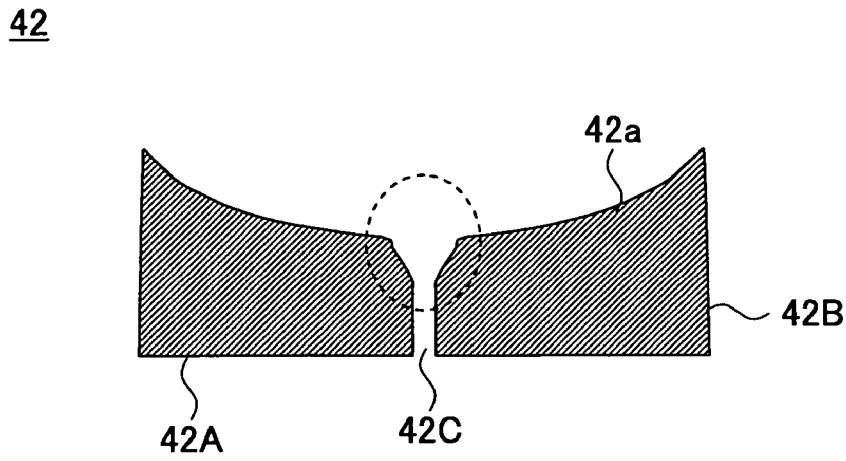
FIGS. 6A and 6B are diagrams showing a part of the planar antenna used with the radio apparatus of FIG. 5.

FIG. 6A shows the shape of the reflector 42*a* of the planar antenna 40 used with the radio apparatus 50 of FIG. 5 in detail.

Figure 6B:
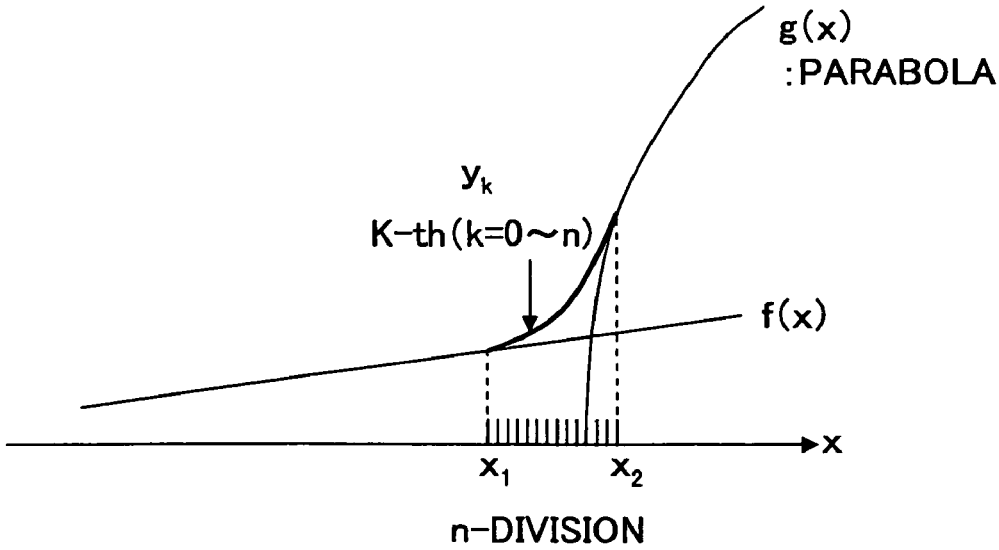

Referring to FIG. 6A, the slot 42C in the slot line 42 and the parabolic curve forming the reflector 42*a* are connected with a smooth function such as the one shown in FIG. 6B, and with this, the present embodiment avoids unwanted sharp change of impedance in such a part.

Referring to FIG. 6B, the function g(x) represents the parabolic line defining the reflector 42*a*, while the function f(x) represents the straight line that defines the shape of the slot 42C.

As shown in FIG. 2B, the interval x1–x2 corresponding to the connection part of the function f(x) and the function g(x) is divided into n small segments, wherein the respective segments are connected by the function $$y_k = \frac{k}{n}\left[\frac{k \cdot f(x_1) + (n-k) \cdot g(x_2)}{n} + \frac{n-k}{k} \cdot f(x_k)\right] \quad (1)$$

where k is a weight.

Of course, the connection of the function g(x) and f(x) is not limited to such a specific function but any other smooth function capable of avoiding sharp impedance change may be used.

FIG. 7 shows the construction of the foregoing line conversion part 52.

Referring to FIG. 7, the line conversion part 52 is formed of the conductor patterns 42A and 42B constituting the foregoing slot line 42, wherein it should be noted that only the slot 42C is formed in the slot line 42, while in the part where the coplanar line $\mathbf{42}_1$ is formed, there is formed another slot 42D extending parallel with the slot 42C in addition to the slot 42C.

Thus, in the case of mounting the semiconductor chip 51 in the construction of FIG. 5, the mounting process is conducted such that a signal pad of the semiconductor chip 51 makes a contact with a signal pattern S provided for the signal region in the conductor pattern 42B between the slot 42C and the slot 42D and such that a ground pad of the semiconductor chip 51 makes a contact with a ground pattern G formed in the conductor patterns 42A and in the part of the conductor pattern 42B located outside the slot 42D.

In the illustrated example, there is formed a T-shaped terminating part at the tip end part of the slot 42D with a signal path length of about a quarter wavelength of the electromagnetic wave, wherein this T-shaped part constitutes the line conversion part 52. With this construction, the electromagnetic wave, which has been guided through the slot line 42 along the slot 42C, is now guided to the signal pad of the semiconductor chip 51 along the signal pattern S provided between the slots 42C and 42D Further, in the case the electromagnetic wave of the millimeter wavelength band is fed to the planar antenna 40 from the semiconductor chip 51, the electromagnetic energy fed to the signal pattern S is transferred to the foregoing slot 42C as a result of the function of the line conversion part 52 and the electromagnetic energy thus transferred is guided through the slot line 42 to the antenna 40 along the slot 42C.

Figure 7A:
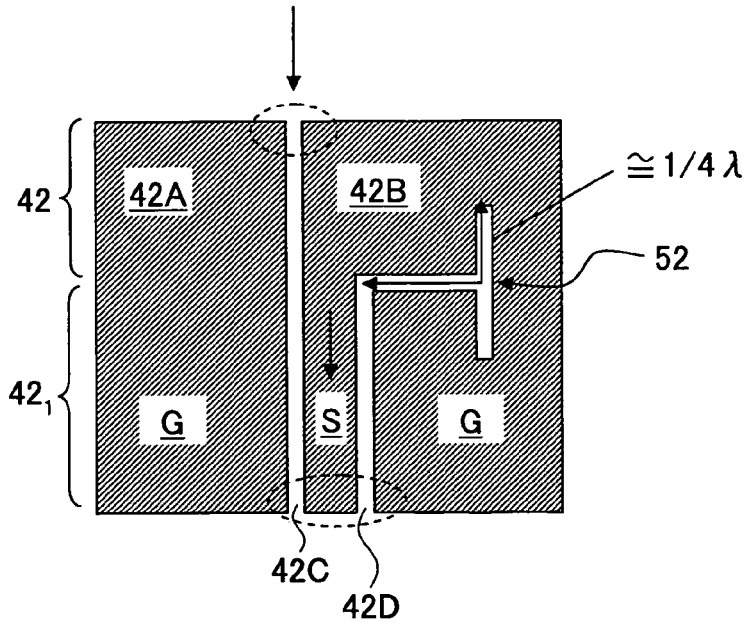
FIGS. 7A and 7B are diagrams respectively showing the construction of a line conversion part used with the radio apparatus of FIG. 5 and conversion characteristics thereof.
Figure 7B:
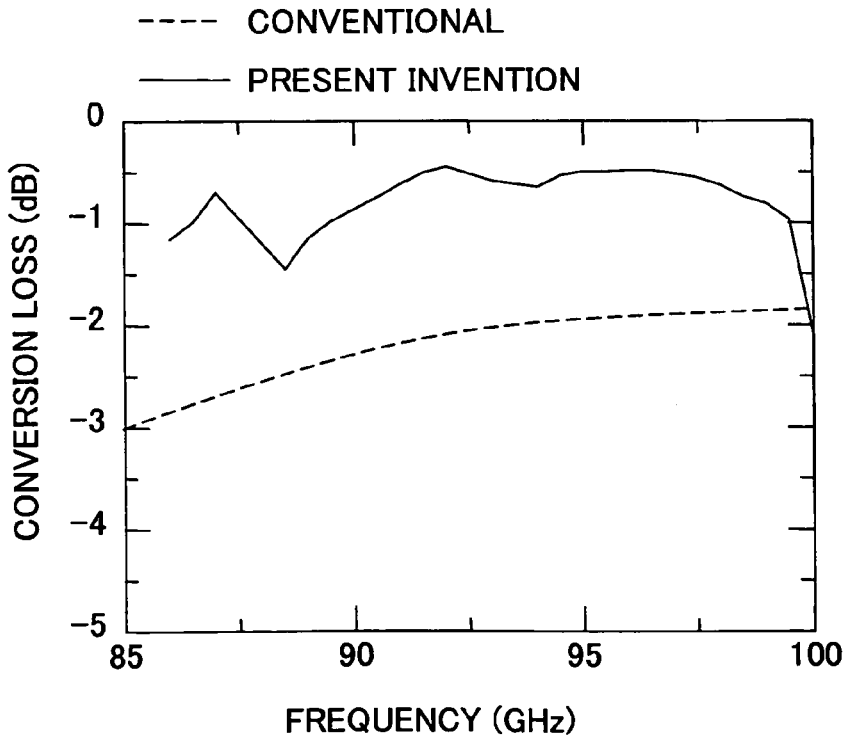

FIG. 7B compares the conversion loss pertinent to the line conversion part 52 of FIG. 7A in comparison with a conventional line conversion part.

Referring to FIG. 7B, it can be seen that the conversion loss can be suppressed to about 1 dB or less with the present embodiment in the wavelength band of 85–100 GHz.

Thus, with the radio apparatus 50 of FIG. 5, it becomes possible to feed the feeble electromagnetic wave collected by the planar antenna 40 to the semiconductor chip 51 constituting the processing circuit by using such a line conversion part 52 between the slot line 42 and the coplanar line 421.

Figure 8:
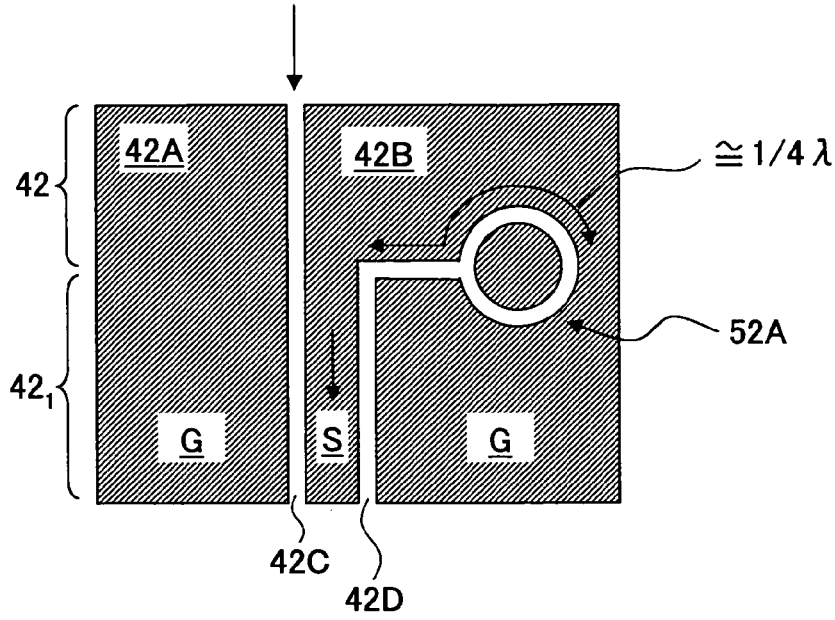
FIG. 8 is a diagram showing another example of the line conversion part.

FIG. 8 shows another embodiment 52A of the line conversion part 52 of FIG. 7A, wherein those parts corresponding to the parts explained previously are designated by the same reference numerals and the description thereof will be omitted.

Referring to FIG. 8, it can be seen that the terminating part at the tip end of the slot 42D forms a ring of the signal path length of about a quarter wavelength, in place of the T-shaped form.

In the embodiment of FIG. 8, too, the electromagnetic energy guided along the slot 42C is transferred to the signal pattern as a result of the action of the line conversion part 52B that includes the foregoing ring-shaped terminating part. Thereby, the electromagnetic wave is guided to the signal electrode pad of the semiconductor chip along the signal pattern S.

Figure 9:
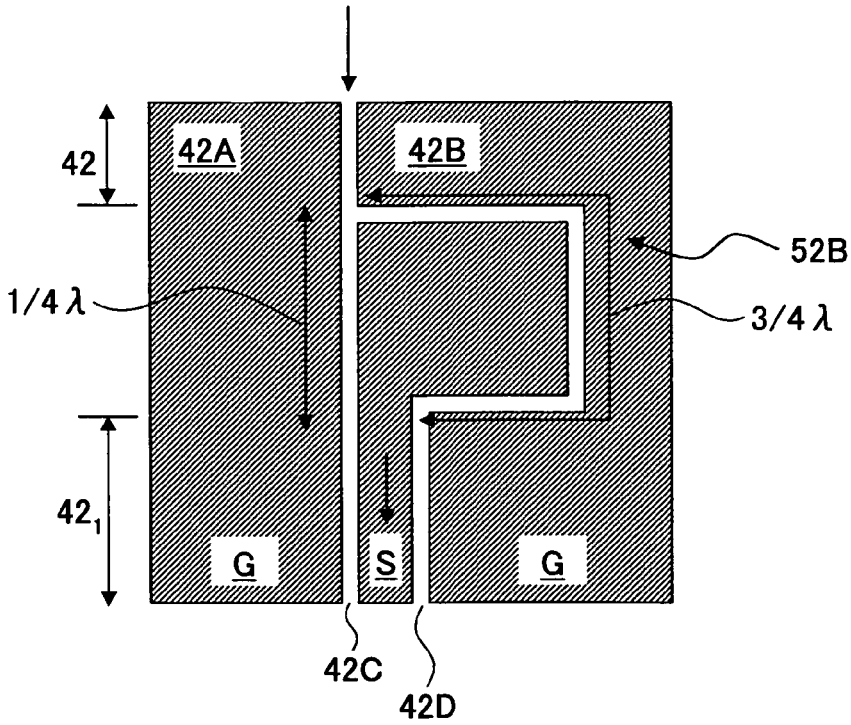
FIG. 9 is a diagram showing another example of the line conversion part of FIG. e7.

FIG. 9 shows a line conversion part 52B according to a further modification of the line conversion part 52 of FIG. 7A, wherein those parts corresponding to the parts described previously are designated by the same reference numerals and the description thereof will be omitted.

In the modification of FIG. 9, the slot 42D is connected to the slot 42C at the line conversion part 52B, wherein the line conversion part 52B provides a path length of a quarter wavelength for the slot 42C and a path length of a three-quarter wavelength to the slot 42D. With such a construction, too, it is possible to realize a connection of little loss between the slot line 42 and the coplanar line 421.

Figure 10:
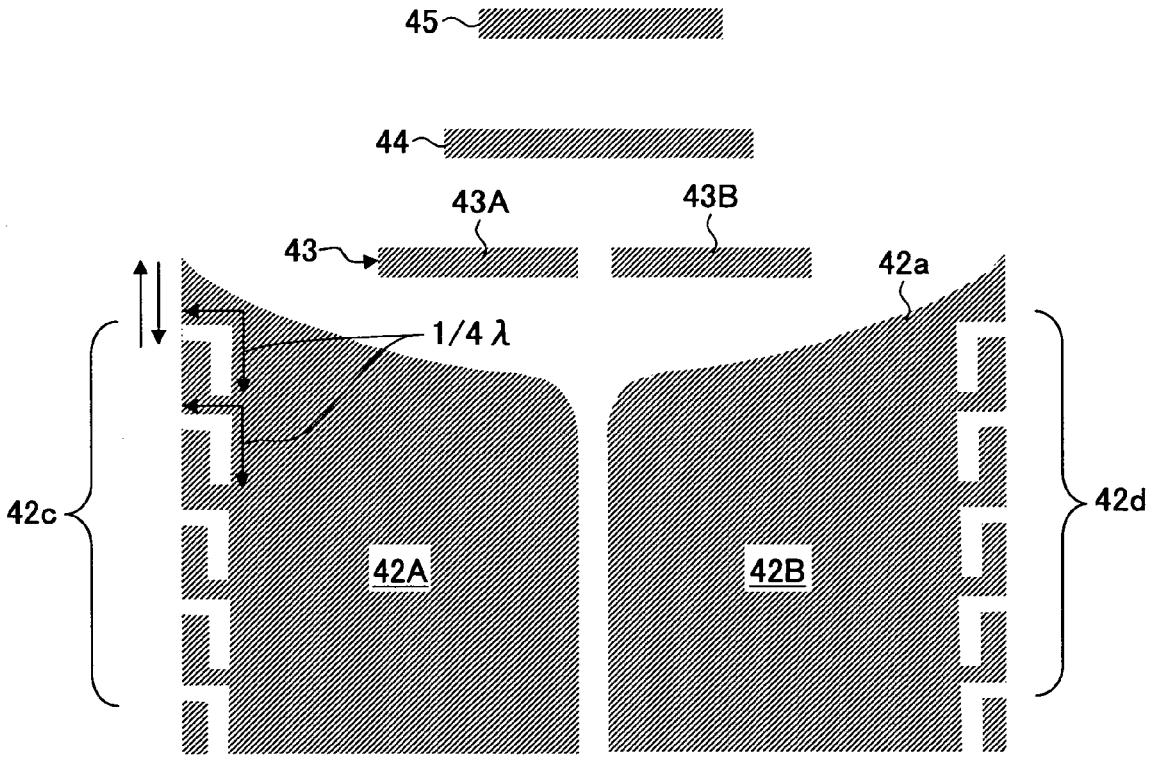
FIG. 10 is a diagram showing an example of a choke structure used with the radio apparatus of FIG. 5.

FIG. 10 is a diagram showing the choke structures 42*c* and 42*d* shown in FIG. 5 in more detail.

Referring to FIG. 10, the choke structures 42*c* and 42*d* are formed of a repetition of L-shaped patterns formed at the side edge of the conductor patterns 42A and 42B, each with the total length of a quarter wavelengths. By providing such choke structures 42*c* and 42*d*, it becomes possible to suppress the propagation of surface wave along the edge part of the conductor patterns 42A and 42D and associated electromagnetic radiation.

Figure 11:
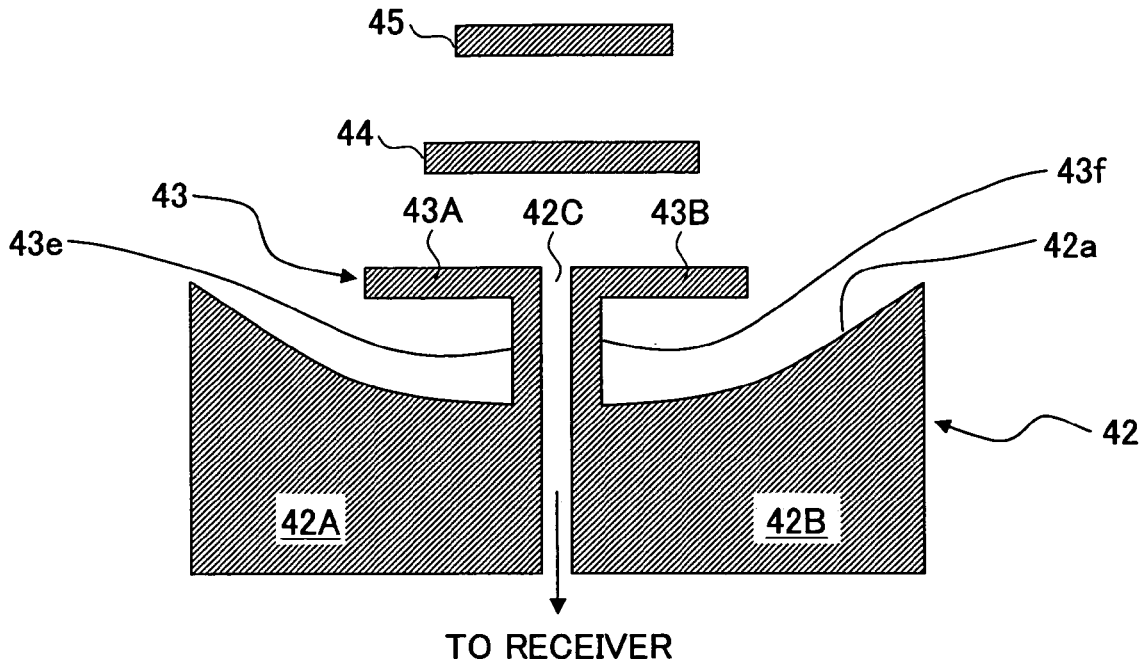
FIG. 11 is a diagram showing another construction of the planar antenna of the present invention.

FIG. 11 shows a modification of the planar antenna of FIG. 3A, wherein those parts corresponding to the parts explained previously are designated by the same reference numerals and the description thereof will be omitted.

Referring to FIG. 11, the present embodiment has a feature that the end part of the slot line 42 extends in the forward axial direction along the slot 42C, and as a result, the conductor pattern 43A constituting the resonator 43 is connected to the conductor pattern 43A via a conductor pattern 43*e* and the conductor pattern 43B is connected to the conductor pattern 42B via a conductor pattern 43*f*.

With such a construction, the slot 42C extends up to the resonator 43 and it becomes possible to directly inject the electromagnetic wave energy collected to the resonator 43 into the slot 42C.

Further, the present invention is not limited to the embodiments described heretofore, but various variations and modifications may be made without departing from the scope of the invention.

What is claimed is:

1. A planar antenna comprising:

a circuit substrate; and a slot line formed on said circuit substrate for guiding an electromagnetic wave in an axial direction thereof, said planar antenna emitting said electromagnetic wave at an end part of said slot line, said end part having a curved shape forming a focal point at a location on an axis of said slot line with offset by a distance of about a quarter wavelength of said electromagnetic wave, wherein there is provided a conductor pattern having a length of about a half of said wavelength of said electromagnetic wave at said focal point.

2. A planar antenna as claimed in claim 1, wherein said end part has a curved shape described by any of parabolic line, hyperbolic line and an elliptic line.

3. The planar antenna as claimed in claim 1, wherein there are provided one or more other conductor patterns in a forward direction of said end part aligned on said axis of said slot line with a distance of a quarter wavelength of said electromagnetic wave from said end part, said other conductor patterns having a reduced width as compared with said conductor pattern.

4. The planar antenna as claimed in claim 1, wherein said slot line includes a slot extending in said axial direction, said slot providing a point of electromagnetic emission at said end part.

5. The planar antenna as claimed in claim 4, wherein said slot transforms a shape thereof to said curved shape of said end part smoothly at said point of electromagnetic emission.

6. The planar antenna as claimed in claim 1, wherein said slot line includes an extension part extending on said axis to said conductor pattern.

7. The planar antenna as claimed in claim 1, wherein there is formed a choke structure at lateral edges of said slot line such that said choke structure is repeated along said slot line with a repetition pitch corresponding to a wavelength of said electromagnetic wave.

8. The planar antenna as claimed in claim 1, wherein said slot line is connected to a coplanar line comprising a first slot and a second slot via a line conversion part on said circuit substrate, said line conversion part connecting said first slot to said slot in said slot line with a signal path length of a quarter wavelength of said electromagnetic wave and said second slot to said slot of said slot line with a signal path length of a three quarter wavelength of said electromagnetic wave.

9. The planar antenna as claimed in claim 1, wherein said slot line is connected to a coplanar line comprising a first slot and a second slot via a line conversion part on said circuit substrate, wherein said line conversion part connects said first slot to said slot in said slot line and said second slot to a terminating structure formed in a conductor pattern on said circuit substrate constituting-said line conversion part.

10. A radio apparatus comprising a planar antenna and a semiconductor device connected to said planar antenna, said planar antenna comprising:

a circuit substrate; and a slot line formed on said circuit substrate for guiding an electromagnetic wave in an axial direction thereof, said planar antenna emitting said electromagnetic wave at an end part of said slot line, said semiconductor device being provided on said circuit substrate commonly to said planar antenna, said end part having a curved shape forming a focal point on an axis of said slot line with an offset by a distance of about ¼ a wavelength of said electromagnetic wave, wherein there is provided a conductor pattern having a length of about ½ a wavelength of said electromagnetic wave at said focal point.

11. The radio apparatus as claimed in claim 10, wherein said end part has a curved shape described by any of parabolic line, hyperbolic line and an elliptic line.

12. The radio apparatus as claimed in claim 10, wherein there are provided one or-more other conductor patterns in a forward direction of said end part aligned on said axis of said slot line with a distance of a quarter wavelength of said electromagnetic wave from said end part, said other conductor patterns having a reduced width as compared with said conductor pattern.

13. The radio apparatus as claimed in claim 10, wherein said slot line includes a slot extending in said axial direction, said slot providing a point of electromagnetic emission at said end part.

14. The radio apparatus as claimed in claim 13, wherein said slot transforms a shape thereof to said curved shape of said end part smoothly at said point of electromagnetic emission.

15. The radio apparatus as claimed in claim 10, wherein said slot line includes an extension part extending on said axis to said conductor pattern.

16. The radio apparatus as claimed in claim 10, wherein there is formed a choke structure at lateral edges of said slot line such that said choke structure is repeated along said slot line with a repetition pitch corresponding to a wavelength of said electromagnetic wave.

17. The radio apparatus as claimed in claim 10, wherein said slot line is connected to a coplanar line comprising a first slot and a second slot via a line conversion part on said circuit substrate, said line conversion part connecting said first slot to said slot in said slot line with a signal path length of a quarter wavelength of said electromagnetic wave and said second slot to said slot of said slot line with a signal path length of a three quarter wavelength of said electromagnetic wave.

18. The radio apparatus as claimed in claim 10, wherein said slot line is connected to a coplanar line comprising a first slot and a second slot via a line conversion part on said circuit substrate, wherein said line conversion part connects said first slot to said slot in said slot line and said second slot to a terminating structure formed in a conductor pattern on said circuit substrate constituting said line conversion part.

19. The radio apparatus as claimed in claim 10, wherein said radio apparatus is a receiver.

20. The radio apparatus as claimed in claim 10, wherein said radio apparatus is a transmitter.

* * * * *